United States Patent [19]

Buda

[11] Patent Number: 4,955,614

[45] Date of Patent: Sep. 11, 1990

[54] WORD FORMING BY ELIMINATION GAME

[76] Inventor: Pualette Buda, 22 Sweet Briar La., Holmdel, N.J. 07733

[21] Appl. No.: 302,182

[22] Filed: Jan. 26, 1989

[51] Int. Cl.[5] ..... A63F 9/16

[52] U.S. Cl. ..... 273/240; 273/272

[58] Field of Search ..... 273/240, 241, 242, 272, 273/299

[56] References Cited

U.S. PATENT DOCUMENTS

| | | | |
|---|---|---|---|
| Re. 24,409 | 12/1957 | Withers | 273/240 |
| 2,460,208 | 1/1949 | Zalkind | 273/240 |
| 2,585,463 | 2/1952 | Horine | 273/240 |
| 3,394,935 | 7/1968 | Beauchaine | 273/272 X |
| 3,503,612 | 3/1970 | Singer | 273/272 |
| 3,826,499 | 7/1974 | Lenkoff | 273/272 X |
| 3,982,763 | 9/1976 | Schlurensauer | 273/240 |
| 4,012,044 | 3/1977 | Grossi | 273/272 |
| 4,059,273 | 11/1977 | Kindred . | |
| 4,123,051 | 10/1978 | Tsacoyannis | 273/272 X |
| 4,185,834 | 1/1980 | Mozzi et al. | 273/241 |
| 4,340,231 | 7/1982 | Cammarata | 273/243 |
| 4,468,035 | 8/1987 | Slepian | 273/243 |
| 4,471,538 | 5/1988 | Lewis | 273/243 |
| 4,512,746 | 4/1985 | Turner | 273/299 X |
| 4,592,553 | 6/1986 | Mammen | 273/272 X |
| 4,637,609 | 1/1987 | Vanderhoof | 273/272 |

*Primary Examiner*—Edward M. Coven
*Assistant Examiner*—William E. Stoll
*Attorney, Agent, or Firm*—Stephan W. White

[57] ABSTRACT

A word-guessing game is described. This game comprises stacks of cards, each of these cards having predetermined words thereon, and each of these stacks having different point values according to the difficulty of the words therein. Players work from pads containing sheets having the letters of the alphabet and scoring areas thereon. After deciding on the point value desired, cards are selected from the appropriate stack and each player attempts to determine the word by eliminating letters to achieve a scrambled version of the word. The scrambed version must then be unscrambled by the appropriate player in order to achieve their point value.

1 Claim, 1 Drawing Sheet

WORD FORMING BY ELIMINATION GAME

BACKGROUND OF THE INVENTION

1. Field of the Invention:

This invention relates to a word forming game wherein players can win points by selecting and guessing words which have varying degrees of difficulty associated therewith. More specifically, this invention relates to a process of playing said game by the elimination of the letters of the alphabet so as to achieve a scrambled version of said word which must then be unscrambled to score.

2. Background of the Invention:

There are a number of prior art references which relate to word-guessing games. These references generally include a variety of board games and the like in which playing tiles may be incorporated, for example. Other include boards on which various letters and the like are placed and then words formed therefrom. All of these prior art games require considerable investment in the parts and pieces of which they consist. Still other prior art word games include use of the so-called cross-word type puzzles in which clues are given and the player— usually a sole player— attempts to guess the word and place the letters in the appropriate boxes on the playing surface. The trouble with the cross-word game is that it must be played by a single individual and it becomes difficult to involve more than one player without considerable changes in the rules thereof.

SUMMARY OF THE INVENTION

There is a need within the art of word-forming or word guessing games for a game which can easily be learned and played, which requires a considerable knowledge of the language, and thereby challenges the intellect of the player in the use of their own language and which does not require considerable and costly parts. There is also a need within this art for games that can be played by a multiple of players and which has all of the aforementioned advantages. These and yet other objects are achieved by providing a word-guessing game played by two or more players, each of said players having a pad, each of said pads having a plurality of sheets associated therewith, each of said sheets containing the letters of the alphabet located thereon and being divided into separate areas for notes and scoring of the individual player and the opponents thereof, and a plurality of stacks of cards, each card within each stack having predetermined words thereon, and each stack having a different point valve set thereon according to the difficulty of the words associated therewith.

DETAILED DESCRIPTION OF THE INVENTION

Figure 1:
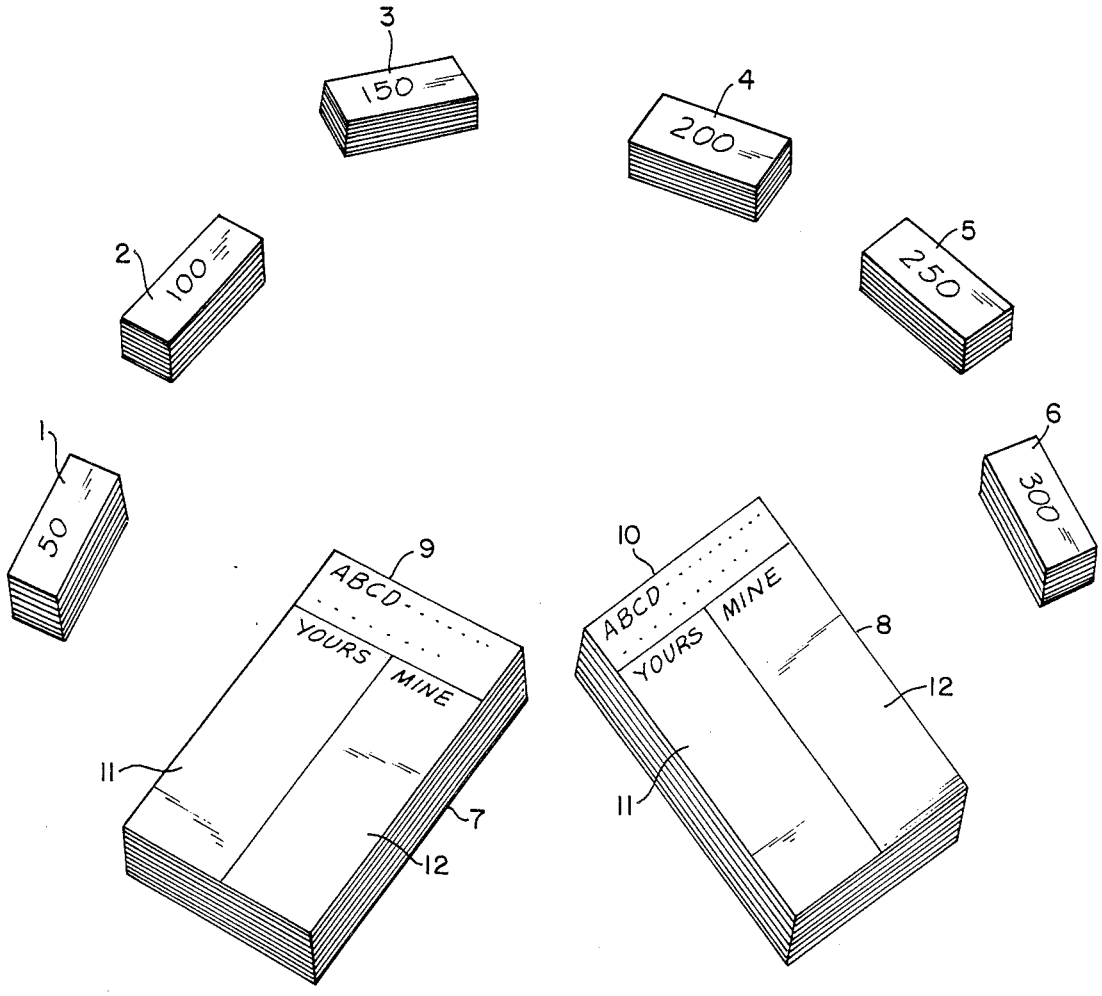
FIG. 1 is a showing of the preferred arrangement of parts used in the playing of this invention.

Referring now specifically to the drawing associated herewith, FIG. 1 shows the various parts of a particularly preferred form used to play the game of this invention, five stacks of playing cards are shown as 1 through 6. Each of these stacks has an increasing value from 50 to 300 points, as related to the difficulty of the words contained therein. Two pads each containing a plurality of sheets associated therewith are shown as 8 and 9 although more pads are used for more players. Each of these pads contains the letters of the alphabet on the top thereof as shown by 9 and 10 although the location of these letters is not important. The pads are further divided into two playing areas by lines indicated in this format as 11 and 12. Each player uses the appropriate playing area to keep track of which letters are in the words for both player and opponent and for keeping appropriate notes thereon.

Figure 2:
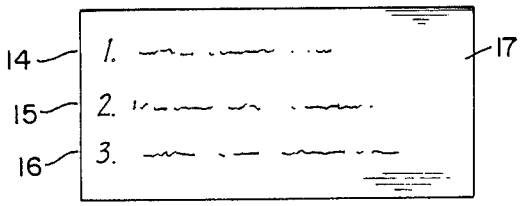
FIG. 2 shows a single card taken from one of the packs from FIG. 1.

FIG. 2 shows one of the cards 13 selected from one of the stacks from FIG. 1. Preferably, each of these cards has three predetermined words on the reverse side shown as 14, 15, and 16, although there can be more or less words if so desired. Preferably, each word has no more than five letters and each of these words contains no double letters. As stated previously, the player with the highest point score wins the game. Pads on which each player keeps their score and on which the words to be guessed by the player and the opponent's letters and words are tracked. Each pad has the letters of the alphabet so that as letters are eliminated they can be scratched. This permits each player to keep track of their letters and thus eliminate letters that are not found in the word to be guessed. It is preferred that there are five stacks of game cards, although there may be more if so desired. Each card in each stack has three words and each stack is worth a different value of points. This is the most convenient configuration of elements for playing this game. It should be understood that the number of stacks, the points given each stack and the number of words and letters associated therewith may be different than shown in the drawings attached hereto. These are only a preferred mode for playing the game of this invention and as such are not specifically related to the novelty of the game as described herein.

In order to better understand just how this game is to be played, a description of the preferred rules follows. At the start of the game, the players involved take one of the pads described above and then decide what the final score will be in points (e.g. from 100–1,000 points, for example). The first player to achieve that score, wins the game.

On each one of the cards in each stack described above there are three words. Since these words are of varying degrees of difficulty, each of the stacks of cards are worth varying points from 50, 100, 150, 200 and 300 , for example. These stacks are then placed on a playing surface (e.g. a table).

The player on the left is the opponent and the player on the right will select the card from the stack selected. Each player can select any stack depending on how many points they wish to achieve in that round. Each word on each card is made up of five letters only and there are no double letters (e.g. "CLIFF" is not in the set of point cards in this example).

Each player then begins trying to guess their own word by the process of ELIMINATING letters that are NOT present in that word. This is done by guessing any particular word that comes to mind. The opponent then tells said player how many of the letters in the word they have given are present in the word that they are trying to guess. Double letters here are acceptable (e.g. "LOOKS" is acceptable with the two "O's" counting as a single letter "O"). By the process of ELIMINATION— e.g. crossing out the letters of the alphabet NOT present in the word that is to be guessed— the players achieve a scrambled version of their word which they must unscramble to get their word.

The player who gets to their word first is the only one to get their points. Thus, time and skill are of the essence. The cards are then replaced in the appropriate stack and another round begins.

Players must keep track of both their words and their opponent's words. This is done on the pad under "MINE" and "YOURS" as shown on the pads in the drawing, for example, and is done so that each can keep track if mistakes are made. If someone does make a mistake, that player loses that "set" and the opponent automatically receives their points. If there are more than two players, every other player will receive half of their own points.

In order to further exemplify the game of this invention, an example of a series of plays follows:

There are two (2) players A and B in this example. Player A selects a 50 point word and Player B decides on a 200 point word. In this case, Player A's word is "RANCH" and B's is "MOUSE".

Player A, going first, asks, for example: "How many letters in the word 'BOOKS' can be found in my word?" both players write that word down, A under "MINE" and B under "YOURS". Player B responds to the question with: "None." since none of those letters appear in the word "RANCH". A then crosses out B O K and S on their alphabet located on their pad and both players place a O next to that word.

Player B continues in a like manner asking a word which they guess will contain lettes in the unknown word "MOUSE".

Continuing, Player A asks, for example: "How many letters in the word 'HOOKS'"? Since "H" does appear in "RANCH", Player B answers: "One." Since O, K and S have been eliminated, Player A now knows that one of the letters in their word is "H".

This continues with words and questions back and forth until each player has eliminated enough letters to know the five letters (scrambled) of their word. The first player to unscramble correctly their word, wins that round and the requisite points attached to their word.

As previously stated, there may be modifications as to the number and types of words to be used in playing this game and the number of words which may appear on each card. Value points also may be changed along with the number of stacks of cards and so forth. The results will be the same. These results yield a challenging, interesting and novel word guessing game by the process of elimination.

I claim:

1. A word-forming game played by a plurality of players comprising a plurality of pads, each of said pads having a plurality of sheets, each of said sheets containing the letters of the alphabet located thereon and being divided into equal and separate areas for notes and scoring of players, and a plurality of stacks of cards, each card comprising two sides, one of said sides containing at least three predetermined words thereon, each of said words comprising at least five letters, none of said words containing double letters, and located on the other side of said cards point values set in increasing amounts according to the degree of difficulty associated with said words.

* * * * *